United States Patent [19]

Bowley

[11] 4,442,750

[45] Apr. 17, 1984

[54] FIBER OPTIC MUSICAL INSTRUMENTS

[75] Inventor: George A. Bowley, McLean, Va.

[73] Assignee: Optical Technologies, Inc., McLean, Va.

[21] Appl. No.: 483,445

[22] Filed: Apr. 14, 1983

Related U.S. Application Data

[63] Continuation of Ser. No. 234,158, Feb. 13, 1981, abandoned.

[51] Int. Cl.[3] ..... G10H 3/06

[52] U.S. Cl. ..... 84/1.18; 84/1.16; 84/1.01; 84/1.24

[58] Field of Search ..... 84/1.16, 1.24, 1.18, 84/1.01, 1.19

[56] References Cited

U.S. PATENT DOCUMENTS

| | | | |
|---|---|---|---|
| 3,733,953 | 5/1973 | Ferber | 84/1.16 |
| 3,941,927 | 3/1976 | Russell | 350/96.29 |
| 4,086,484 | 4/1978 | Steensma | 350/96.29 |
| 4,151,747 | 5/1979 | Gottlieb et al. | 350/96.15 |
| 4,228,716 | 10/1980 | Linford | 84/1.18 |
| 4,235,113 | 11/1980 | Carome | 350/96.29 |
| 4,238,856 | 12/1980 | Bucaro et al. | 350/96.13 |
| 4,255,018 | 3/1981 | Ulrich et al. | 350/96.29 |
| 4,294,513 | 10/1981 | Nelson et al. | 350/96.15 |
| 4,296,319 | 10/1981 | Franks et al. | 350/96.15 |
| 4,321,463 | 3/1982 | Stecher | 84/1.18 X |

*Primary Examiner*—Forester W. Isen

*Attorney, Agent, or Firm*—Kerkam, Stowell, Kondracki & Clarke

[57] ABSTRACT

A fiber optic musical instrument provides a design in which the musical notes and characteristic instrument sounds normally sensed by electro-mechanical devices such as magnetic pickups and acoustic transducers are generated by the modulation of light within optical fibers and are optically transmitted to amplifying devices without the need for externally mounted sensing devices.

11 Claims, 28 Drawing Figures

FIBER OPTIC MUSICAL INSTRUMENTS

This is a continuation of pending prior application Ser. No. 234,158, filed on Feb. 13, 1981, now abandoned.

BACKGROUND OF THE PRIOR ART

General Musical Instruments

A musical instrument is a device that is able to generate musical vibrations and launch them into the air. Each instrument sound is characteristically different according to its tone color or timbre; that is, a combination of a fundamental vibrational mode and a number of harmonics, or overtones, of varying amplitudes which uniquely distinguish its sound from the sounds of other instruments. Instrument sounds are also characterized by pitch (determined by the rate of vibration); the duration of the vibration, and the dynamic range of the instrument as determined by the force of the vibration.

Musical instrument sounds are generated in various ways including the setting into motion of one or more strings mounted on the instrument body; an instrument body or stretched membrane set into vibration by external percussion; or the blowing of air through a series of air columns, cavities, channels or reeds. These vibrations are transmitted from the instrument through the air and are received by the human ear at an intensity determined by the distance between the instrument and the receiver.

In instances where an amplification of the instrument sound is required, an audio microphone can be placed in close proximity to the instrument body to pickup the vibrations and electrically transmit the sounds to an amplification system. In some instances, it is desired to isolate the instrument from its immediate surrounding and provide single channel amplification through the use of a contact microphone, or acoustic transducer, which is affixed directly to the instrument to pick up the vibrations in the body.

Stringed Musical Instruments

Stringed musical instruments generally consist of one or more strings, stretched across an acoustic cavity between two fixed points, which are set into vibration by wind, picking, plucking, striking, strumming, or friction by drawing a bow across. The unique sound of each instrument is dependent upon its basic construction, method of mounting the strings, string tension, string size, composition and mass, method of playing and other factors.

The amplification of a stringed instrument is usually accomplished by an audio microphone (airborne sound) or contact microphone (direct vibration pickup) as described above. In some instruments, such as a guitar, a metal string can be used in conjunction with a magnetic pickup to create a magnetically induced electrical signal for amplification.

Percussion Musical Instruments

Percussion musical instruments produce sound principally after being hit by an external force, or, depending upon the type of instrument: struck together, shaken, scraped or rubbed. In the drum family, a thin membrane is stretched across an acoustic cavity and is set into vibration by sticks or the bare hand (membranophones). Other percussion instruments, such as the xylophone, consist of tuned pieces of metal or wood, placed over resonant acoustic cavities, which are hit by mallets or other devices (idiophones).

Because of the large and varying sizes of the drum group, and the number of individual note generators in other percussion instruments, amplification has mainly consisted of the use of audio microphones placed in proximity to the acoustic cavities in lieu of the use of individual acoustic transducers.

Wind Musical Instruments

Wind instruments are those in which the sound is produced by a partially enclosed body of air that is caused to vibrate through some kind of primary vibrator or generator activated by wind from the lungs or bellows. Among these, three main classes are usually recognized; distinguished by the nature of the generator employed: Flute, Reed and Brass.

In flute instruments, the generator is the eddy formation which occurs when the wind, issuing from a slit, stikes a solid edge cut in the wall of the instrument and open to its interior. In reed instruments, the wind causes a thin, tonguelike elastic piece (called a reed) to vibrate and create a stationary wave within the pipe. Brass instruments are those in which the player's lips are tensed across an aperature in the instrument in order to vibrate under breath pressure. The amplification of wind instruments has been accomplished almost entirely by audio microphones used during the recording or broadcasting process. Because of their normally loud volume, there has generally been no need to attach individual pickups to these instruments, although there have been occasions where acoustic transducers have been placed on clarinets and other reed instruments for particular effects; and particulary on related reed-family instruments such as the harmonica and accordian.

General Amplification Methods

Each amplification method previously cited has a number of significant drawbacks:

- Although the use of audio microphones provides the best frequency response and are extensively used in the broadcast, recording and sound reinforcement media, they are best suited for situations involving semi-fixed positions and are not convenient in portable, highly mobile circumstances. Microphones amplify the surrounding environment in addition to the specific instrument, and are highly prone to feedback, in which the amplified sound from the speaker is fed back through the microphone, causing an objectionable squealing sound.
- Contact microphones (vibration transducers) must be placed at a point on the instrument body that optimizes the total sound of the instrument, which is often non-existent since each part of the body consists of different material thickness, varying compliance and other mechanical factors. In addition, the total instrument body becomes, in a sense, a cavity microphone reproducing all sounds inpinging upon it; which also makes it vulnerable to feedback and impact-type noises.
- Magnetic pickups vary in their frequency response capabilities and are basically non-linear devices. The alignment of strings over respective magnetic pole pieces is continually changing and the coils of wire within the pickup induce extraneous noise and hum into the musical signal.

The most serious drawback of all three methods involves the need to use electrical cable between the instrument pickup and the amplification system some distance away. A shielded electrical cable can be thought of as a series of inductive and capacitive elements which act as a series of low pass filters rolling off high frequencies as the cable distance increases. A generally accepted rule states that significant high frequency degradation occurs in high impedance systems (as found in current musical instrument pickups) with cable lengths in excess of fifteen feet. In addition, electrical cables also induce static and hum in unbalanced systems.

The Guitar

In particular reference to a stringed instrument in the form of a guitar, which is the preferred embodiment of this invention, its basic design and method of amplification have not changed over the past forty years. In the early 1900's all guitars were acoustic. Efforts to amplify the acoustic output of these guitars in the 1920's—1930's widely consisted of using contact microphones (vibration-sensitive transducers) to pickup the vibrations in the body of resonant cavity of the guitar. Later, magnetic pickups were used under the strings of acoustic guitars to electrically induce a current in a set of coils caused by changes in magnetic flux created by vibrating metal strings. In the 1940's, it was recognized that there was no need to utilize the acoustic property of the guitar body if only the electrical signal was to be used to provide the musical note. Magnetic pickups were then mounted directly on a solid wood body with no acoustic cavity underneath, and the solid body guitar concept became a reality.

Since that time, there has been little innovation in guitar design. Aside from minor style changes and body configurations such as the cut-away style, number of pickups, pickup switching techniques, etc., the electric guitar has not significantly changed from its basic concept. In the mid 1970's, the guitar industry recognized the rapid technological advances being made in the miniaturization of electronic components and circuitry and started to integrate special devices (reverberation, vibrato, phase shifters, etc.) into the body of the quitar itself. Later a guitar synthesizer was developed wherein the guitar is used to generate variable voltages to control the inputs of voltage controlled oscillators (VCO's).

Current innovations in electric guitar design and technology all center about the continuing use of the magnetic pickup as the primary transduction mechanism for translating the musical note generated by the vibrating string into an electrical signal suitable for amplification. Although magnetic pickups have serious drawbacks relating to limited response and extreme sensitivity to external noise and hum, they appear to be the chosen method of pickup design to be used for some time to come.

BRIEF SUMMARY OF THE INVENTION

The present fiber optic musical instrument eliminates the need for external acoustic, magnetic or other conventional pickup designs. The instrument uses optical fibers as a vibrating medium in lieu of conventional strings, or uses optical fibers in conjunction with membranes or other mechanisms unique to the particular instrument. Light emitted from light emitting diodes (LEDs), laser devices or other optical sources is transmitted down the length of the fiber(s) and detected at the other end by individual photodetectors which either sense the:

intensity-modulated light caused by microbending or polarization vector rotation phenomena (among others), or the;

phase-modulated light caused by pressure variations or other interactions of various energy froms (magnetic, RF, thermal) on specially coated fibers, as sensed through known fiber optic interferometric techniques.

The modulated light signals from the strings or fiber/membrane combinations are either optically mixed within the instrument and sent via a single optical fiber cable, or individually transmitted through multifiber optical cable, to a detection/amplification process apart from the instrument. Hybrid versions of this concept, one of which is described herein, may consist of certain optical source and detection functions being performed within the instrument itself, yielding an electrical instead of an optical output.

The invention will be more particularly described in reference to a fiber optic guitar; however, it will be recognized by those skilled in the art that the invention is not restricted to guitars, but is applicable to any of a large family of stringed, percussion, wind, brass and keyboard instruments including:

STRINGED INSTRUMENTS: Acoustic guitar, acoustoelectric guitar, aeolian harp, autoharp, biwa, banjo, bass, cello, cimbalom, cittern, double bass, dulcimer, electric bass, electric guitar (solid body), fiddle, gittern, hackbrett, harp, hurdy gurdy, kamanga, koto, lute, lyre, mandolin, psaltry, rabab, saranga, sarinda, steel guitar, theorbo, tromba marina, ukelele, viol, viola, violin, zither.

PERCUSSION INSTRUMENTS: Bass drum, bongo drum, cabaca, castanets, celesta, chimes, claves, cymbals, finger cymbals, glockenspiel, gong, guiro, kakko, kettledrum, maracas, marimba, naker, shoko, sistrum, snare drum, spoons, tabor, taiko, tambourine, tenor drum, triangle, tubaphone, vibraphone, wood block, xylophone.

WOODWIND INSTRUMENTS: Aulo, baryton, bass clarinet, bassoon, clarinet, contra-bassoon, crumhorn, english horn, flageolet, flute, gourd flute, harmonica heckelphone, hirchiriki, kaval, launedoa, oboe, ocarina, oteki, panpipe, piccolo, rackett, recorder, sarrusophone, saxaphone, shawm, sho, swanee whistle, tarogato.

BRASS INSTRUMENTS: Alpenhorn, bass trumpet, bugle, coronet, double horn, euphonium, flugelhorn, french horn, ophicleide, posthorn, trombone, trumpet, tuba.

KEYBOARD AND OTHER INSTRUMENTS: Accordian, bagpipe, harpsichord, organ, piano, pianoforte, sansa.

The concept of the invention as described in reference to a fiber optic guitar in the following detailed descriptions involves the use of optical fiber strings in place of the metal alloy string and magnetic pickup configuration of current electric guitar design. This transition to a totally optical process within the instrument (with a comcomitant optical signal transmission from the instrument) will realize the following significant advantages and improvements:

Hum and other noise induced by magnetic pickups and associated wiring is eliminated. The fiber optic configuration is not susceptible to induced electromagnetic or Radio Frequency (RF) radiation phenomena. Therefore, noises caused by a proximity to alternating current wiring, large power supplies or RF transmitters are no longer a concern.

The use of a fiber optic cable from the instrument to the amplifier will eliminate the high frequency roll-off normally experienced with long cable runs. The signal generated by the instrument will essentially be received intact at the amplifier with no frequency degradation over long distances (even up to 10 miles without a repeater).

Similarly, the use of an optical fiber cable eliminates the susceptability to induced hum and noise normally associated with long runs of shielded electrical cable.

The limitations associated with magnetic devices commonly used as guitar pickups will be eliminated. These limitations include non-linear operation, limited frequency response, resonance peaks and continuously varying impedances presented to the load as a function of the generated frequency.

Increased instrument frequency response will be experienced due to the extremity wide bandwidth of a fiber optic system (often up to 400 MHz). The instrument output will be nearly flat from DC to well beyond the range of hearing and feel.

Misalignment in the positioning of the string exactly over its respective magnetic pickup pole piece, while at rest, is eliminated. The wide displacements, caused by excessive bending of strings while playing which displaces the string from its pole piece magnetic field, will no longer affect the quality of the generated sound since the tonal quality is determined within the string itself.

The electrocution potential that exists when a performer touchs the instrument and another surface connected to a different electrical ground system is eliminated since there are no purely electrical components in the totally optical guitar.

Fiber strings will not be degraded by hand/finger moisture as are the metal alloy strings. Monthly, weekly, or sometimes daily string changing to restore string total quality will no longer be required.

String breakage will be minimized since certain optical fibers can withstand tension up to 100,000 pounds per square inch.

The modular aspect of the fiber optic system makes it easy to maintain. Modular component replacement makes field repair easy and attractive to the performer "on the go".

The basic configuration of the current, for example, guitar is unchanged, making it physcologically acceptable during its introduction. Strings are replaced in essentially the same manner, are tuned with existing tuning head mechanisms, and no physical modifications to the guitar shape are required.

The use of a light source in the visible spectrum will offer psychodelic illusions (i.e., vibrating colored strings in the dark) which will appeal to rock groups and others who value an unique appearance as well as quality of sound.

Similar advantages relative to hum, noise frequency response preservation, linearity and shock protection apply to other musical instruments applicable to this concept.

DETAILED DESCRIPTION OF THE INVENTION

Definitions

"Optical fiber" or "fiber" as used herein means a light transmitting element which utilizes fibers of various compositions including plastic core/plastic cladding; plastic core/glass cladding; glass core/glass cladding; glass core/plastic cladding, with doping materials in either or both core and cladding. The fibers may be multimode fibers of the step index or graded index variety, or other fiber manufactured with a specific gradient of refractive indices, or single mode fibers with a small core (generally 2–10 microns) with high cladding to core ratios.

The terms "light", "light source" or "optical source" mean a variety of optical light sources including incadescent bulbs, fluorescent bulbs, focused natural light, light emitting diodes (LEDs), gas lasers and injection diode lasers, which will function at a number of optical wavelengths including visible light, ultraviolet, infrared, and higher wavelength.

The terms "detector" or "detection schemes" include a variety of devices such as phototransistors, silicon diodes, PIN diodes, Avalanche Photo Diodes (APDs) and the like.

Fiber Optic Musical Instruments

Figure 1:
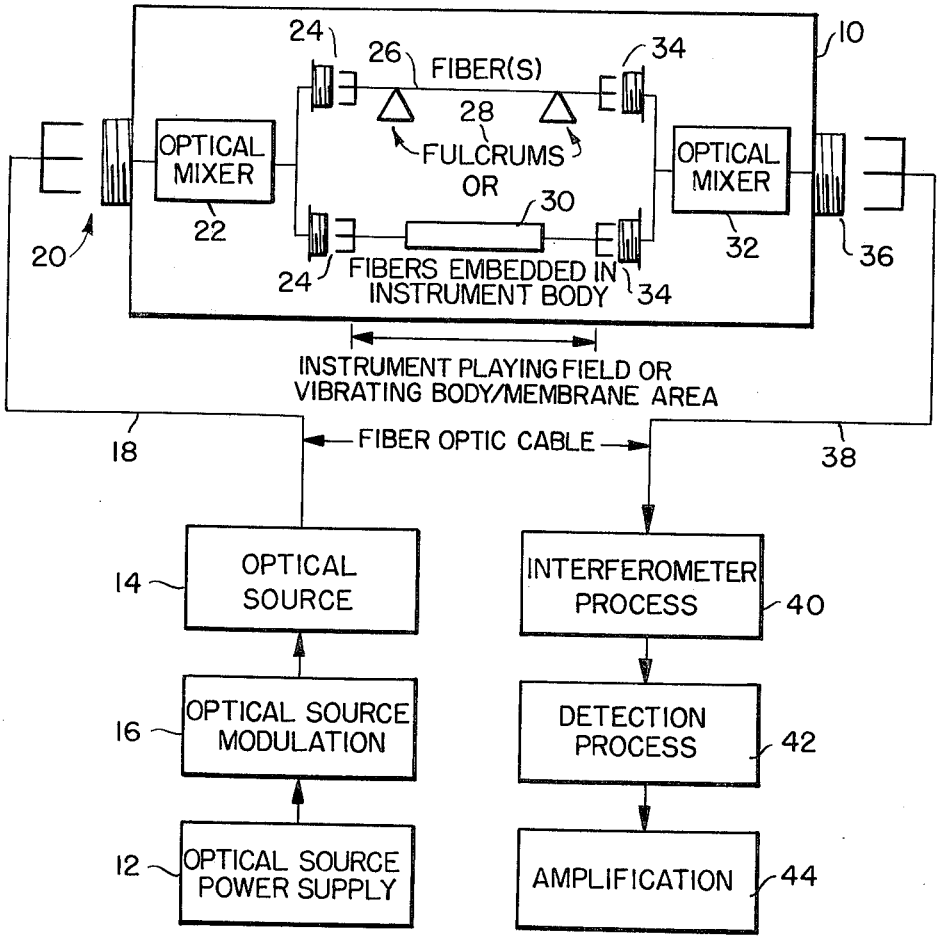
FIG. 1 is a basic block diagram of one system of the present invention.

Referring to FIG. 1 of the drawing, 10 generally designates any musical instrument of the stringed, percussion, woodwind, brass and keyboard families with optical fibers stretched between fixed points; attached to or imbedded in the instrument body.

Figure 21:
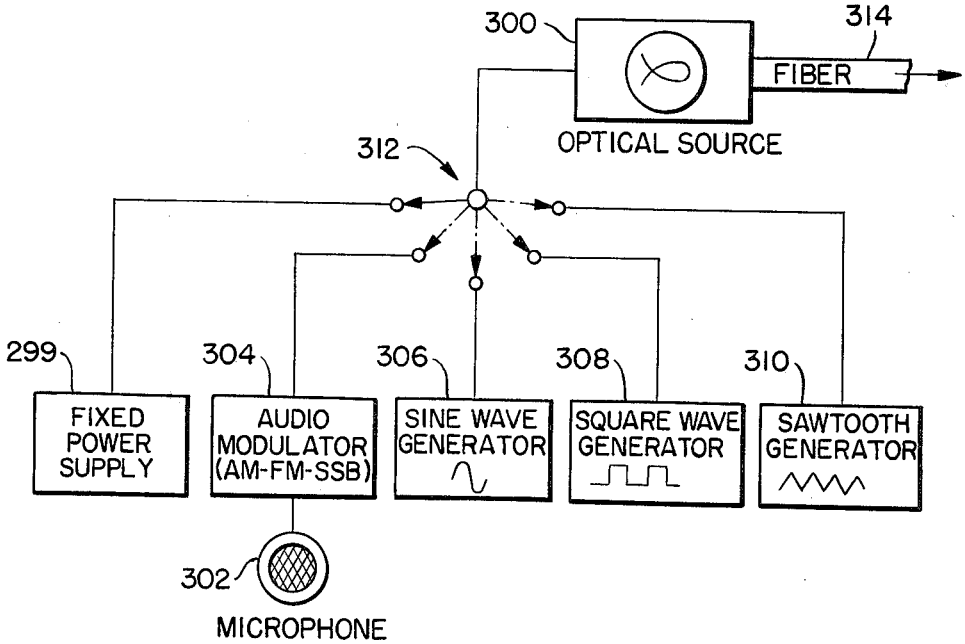
FIG. 21 is an illustration of optical source modulation techniques.

A power supply 12 provides alternating current (AC) or direct current (DC) power to an optical source 14 consisting of a LASER(s), Light Emitting Diode(s) (LEDs), incadescent bulb(s) or other means of illumination. If desired, the intensity or phase of the the optical source can be varied by a modulator 16 which is capable of superimposing audio, sine waves, sawtooth or other waveforms as illustrated in FIG. 21 to provide required special effects.

The light is communicated to the body of the musical instrument 10 via a fiber optic cable 18 consisting of one or more optical fibers of conventional design, and connected to the instrument by a single or multifiber connector 20. The light is introduced into a required number of optical mixers 22 which divide the light into a number of separate fiber channels for application to individual instrument fiber ends. The optical mixer can be eliminated if only a single fiber were involved in the instrument design.

The distributed light is applied to input fiber optic connectors 24 which interface with fibers 26 stretched across fulcrum points 28 in the instrument playing field (such as guitar, piano and harp) or fibers attached to or imbedded in the instrument body 30 (such as a drum head, wind instrument and xylophone). The playing of the musical instrument causes the light in the optical fiber(s) 26 and 30 to be intensity or phase modulated in accordance with the modulating techniques described within this invention and illustrated in FIGS. 2 through 8.

The modulated light output is sent to a second optical mixer 32 via output fiber optic connectors 34. Connectors 24 and 34 facilitate the installation, removal and replacement of fibers as required. The modulated light is then sent via a second fiber optic connector 36 and fiber optic cable 38 to detection and amplification devices 40, 42 and 44 as follows:

If the light output of the musical instrument is phase modulated, the light is applied to an interferometric process 40 as described within this invention prior to being applied to a detection process 42.

If the light output of the musical instrument is intensity modulated, it is applied directly to the detection process.

It will be possible to perform analog to digital conversion, multiplexing techniques and other optical data transmission techniques to the fiber optic musical instrument output as required to trasmit the signal(s) to the detection process.

The detection process 42 consists of phototransistor(s), PIN Diode(s), Avalanche Photo Diode(s) (APDs) or other known detection schemes which convert light into a corresponding electrical signal. In the case of the fiber optic musical instrument, the modulated light and hence the electrical output of the detector 42 is directly proportional to the vibrations within the instrument 10 as sensed by the fibers 26 and 30. The output is amplified by conventional means 44 for listening, recording, broadcasting or other desired functions.

There are a number of modulating techniques which can be utilized with the fiber optic musical instrument involving both intensity modulation and phase modulation of the light contained in the instrument fiber(s).

Intensity Modulation

The intensity modulation process, described hereinafter in reference to FIG. 1 and preferred embodiments of this invention, is the easiest modulation scheme since it does not involve the use of additional interferometer devices, specialized fibers or sensitive beam splitting devices. The intensity modulated light from the musical instrument directly illuminates the face of a photodetector to convert the light flunctuations to audible sound. In addition, components are lightweight, low cost and rugged; all attractive for the consumer.

There are a number of possible intensity modulation techniques or variations which are applicable to this invention. Two of these involve the detection of light losses induced by transverse stress microbending, and light losses caused by the rotation of polarization vectors.

Microbend Losses

It is known that a microbend in an optical fiber carrying a light beam is a stress applied perpendicular to the fiber's axis of sufficient size to cause coupling between light modes. The mode coupling is a duffusion process which causes guided light modes to be converted to radiation modes, resulting in a power transfer from the core.

Figure 2:
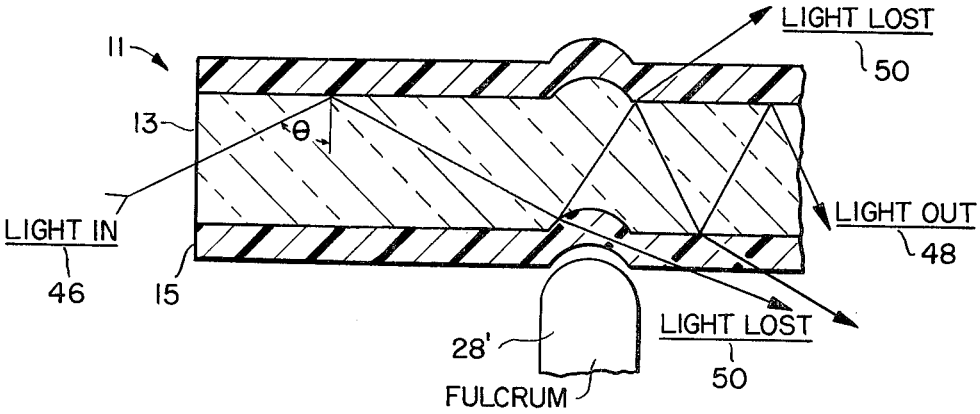
FIG. 2 is a diagramic illustration of a transverse stress microbend loss modulation modifying means of the invention.

Referring to FIG. 2 of the drawing, incoming light 46 is introduced into the input end of the fiber 11 consisting of a core 13 and lower index of refraction cladding 15, which propogates down the fiber in accordance with known teachings. When a disturbance is reached (such as a distortion in the fiber wall due to a fulcrum point 28', instrument bridge or other fixture) light is lost into and through the cladding of the fiber as described. The light output 48 of the fiber is reduced by the amount of the light lost 50.

When the fiber is set in motion, a varying disturbance is created upon the fiber by the stationary fulcrum point(s) and the light lost due to the microbending principle varies in direct proportion to the variation of the disturbance.

Thus

LIGHT IN−LIGHT LOST=LIGHT OUT

The amount of loss is given by:

$$\frac{Ca_c^4}{\Delta^3} \text{ where } C = 0.9\,\frac{\sigma h^2}{b^6}\left(\frac{E_j}{E_f}\right)^{3/2}$$

where:

$a_c$=Radius of the fiber core b=Fiber radius $\Delta$=Index of Refraction difference: $(n_1-n_2)/n_1$ $\sigma$=Bump density in bumps per unit length h=RMS heights of the bumps $E_j$=Elasticity modulus of the buffering jacket (if any)

$E_m$=Elasticity modulus of the fiber

The intensity and periodicity of the light loss can be detected either by sensing the varying reductions of output light 48 or by sensing only the light lost 50. The intensity of the light loss is a function of a number of factors including the radius of the fiber and its core, the indices of refraction, number and extent of the disturbance, and elasticity moduli.

The fiber optic musical instrument utilizes the microbend principle to generate the musical note. As the fiber is deflected from equilibrium position and allowed to vibrate at its fundamental natural frequency, alternating forces are imposed on the fiber at its two fulcrum points. The mode coupling and radiation losses occuring will create power transfers proportional to the rate of fulcrum pressure i.e., the vibrating frequency. This alternating power loss is read as a corresponding attenuation by the detector, and the electrical output will be a varying signal proportional to the vibrating fiber.

Polarization Losses

Figure 3:
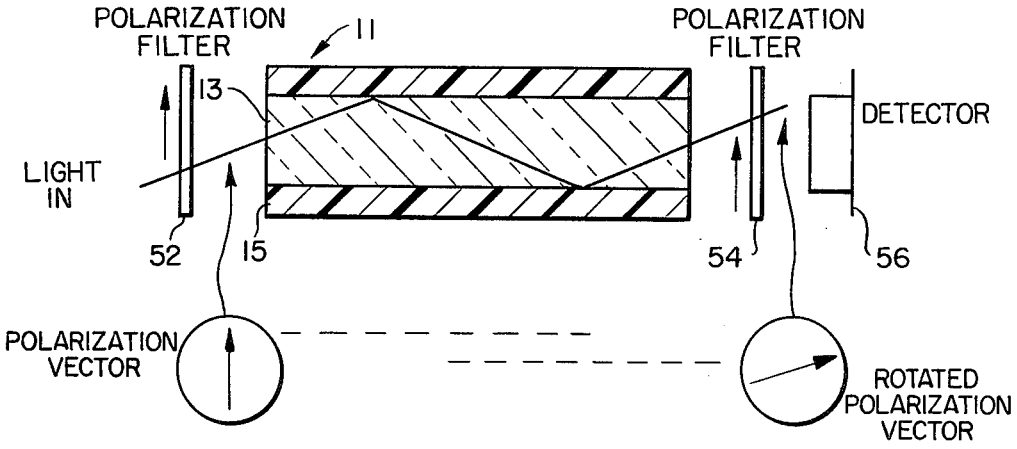
FIG. 3 is a diagramic illustration of intensity fluctuations due to a shift in polarization vector which is another form of modulation modifying means of the invention.

It is also known that there is a linear relationship between the angle of rotation of an optical fiber (torsion) and the rotation of polarized light traveling within the fiber. The fiber optic musical instrument can utilize this phenomenon to detect the fiber's frequency of vibration by observing the periodic attenuation of light due to this polarization rotation. Referring to FIG. 3 of the drawing, polarized light is used as a light source; if not from a laser, then from an LED or other source whose light has been passed through a polarizing filter 52. A similar polarizing filter 54 is installed over the photodiode area 56 and oriented to either maximize or minimize the light transmission coefficient at equilibrium depending on the desired method of detection. A deflection of the fiber 11, having core 13 and cladding 15, and subsequent vibration will cause a slight rotation of polarization within the fiber. Since the direction of polarization has been fixed at the detector 56 by the filter 54, changes in polarization are interpreted as a series of increases or attenuations in the light beam depending on the method of detection chosen. The rate change in polarization, and hence the attenuation periodicity, is directly proportional to the vibration frequency.

This polarization method can be used singly or in conjunction with the microbend process in order to insure a more complete light intensity detection of fiber vibrations, with potential advantages of increased sensitivity, signal to noise ratio and a more complete translation of mechanical to electrical displacement. Long fiber lengths and string displacement distances serve to enhance this torsion effect.

Phase Modulation

In addition to intensity modulation techniques, phase modulation may be employed within the fiber optic musical instrument for translating fiber vibrations to electrical signals.

Interferometry

Figure 4:
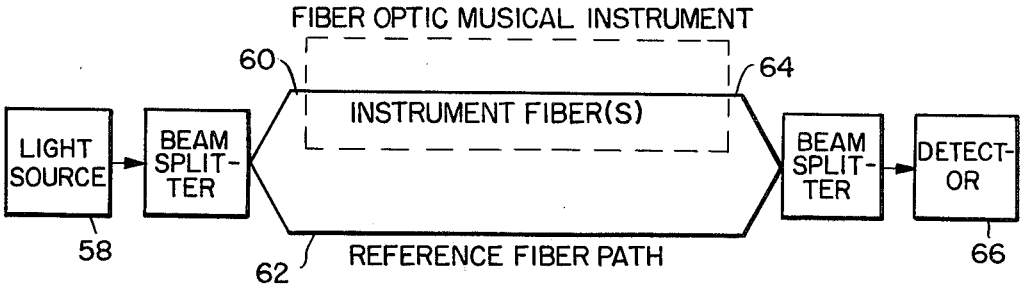
FIG. 4 is a diagramic illustration of an interferometric process for the detection of optical phase shifts induced by a fiber optic musical instrument.

Phase modulation techniques employ currently known interferometric methods as illustrated in FIG. 4. An optical interferometer is a measurement instrument that utilizes interference pattern phenomena based on the wave properties of light. Interferometers function by dividing a light wavefront into two or more parts which in turn travel different paths and recombine to form interference fringes. The nature of the interference pattern is determined by the difference in optical paths traveled by the recombined wavefronts.

The fiber optic musical intrument utilizes the interferometry principle to detect musical notes resulting from the shift in phase of the light contained in the optical fiber. Referring to FIG. 4 light from the light source 58 is divided into two fiber paths 60 and 62. One fiber 60 is subjected to the playing phenomena (pressure, magnetostriction, radio frequency, temperature among others) described herein which produces optical path length changes in the fiber which, in turn, cause phase fluctuations in the contained beam of light. The other fiber 62 is isolated from the playing phenomena. The phase modulated light beam 64 is then compared with the isolated reference light beam in fiber 62, resulting in the detection 66 of variations which are proportional to the vibrations experienced by the playing fiber 60.

Pressure-Induced Phase Shifts

Figure 5:
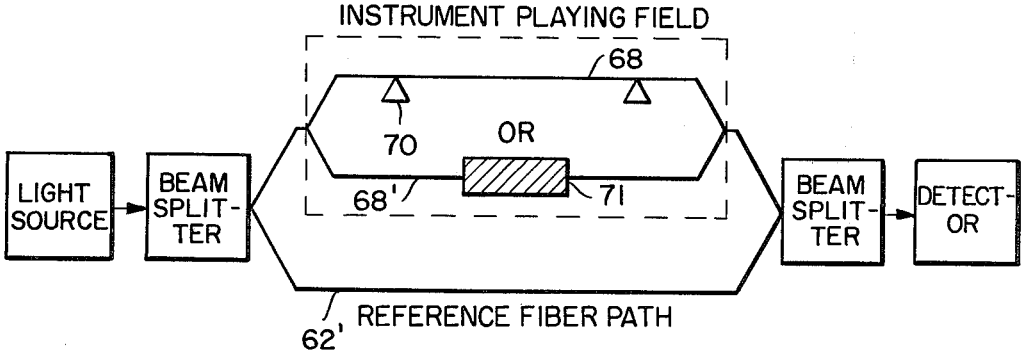
FIG. 5 is a diagramic illustration of a form of phase modulation modifying means of the invention involving pressure induced optical phase shifts.

Referring to FIG. 5, external pressures are applied to the optical fiber(s) 68 when stretched and vibration between two fixed points 70. These variations in pressure cause the axial changes in the fiber path length and resultant optical phase shifts previously described.

In addition, fibers 68' are imbedded into, or attached to, the body of the musical instrument at points 71 of maximum vibration, musical quality or other criteria. The vibrations exert a similar pressure onto the fiber to achieve the same optical shift effect, referenced against the reference fiber 62'.

Magnetostrictive-Induced Phase Shifts

Figure 6:
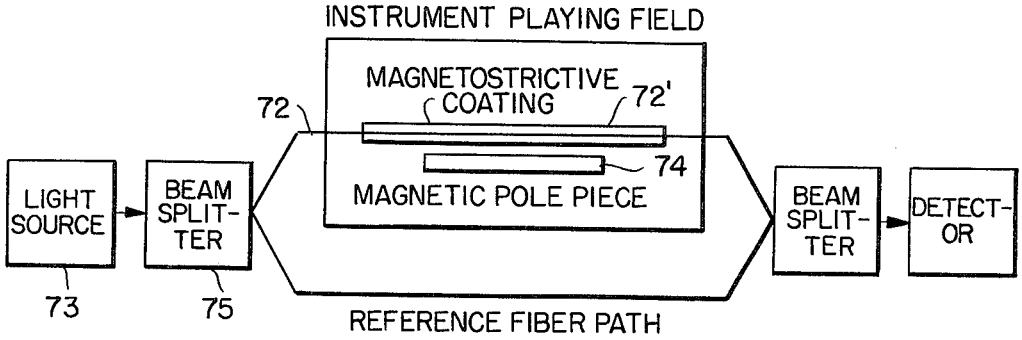
FIG. 6 is a diagramic illustration of magneto-strictively induced optical phase shifts which is another form of modulation modifying means of the invention.

Referring to FIG. 6, fiber(s) are coated or encapsulated in a magnetostrictive substance such as nickel or other alloy which constricts when subjected to an external magnetic field. The coated part 72', of the fiber 72, when caused to vibrate in the magnetic field created by pole pieces of a magnet 74 (including that of a conventional guitar magnetic pickup, not illustrated) is subjected to a periodic stress induced upon the fiber in direct proportion to the frequency of vibration of the fiber, thus causing an equivalent periodic elongation of the fiber path length. The resultant phase modulation of a beam of light from source 73 and beam splitter 75, within the fiber is then detected and employed as an output, either singly or combined with a similar signal generated by another transduction means.

Radio Frequency (RF)-Induced Phase Shifts

Figure 7:
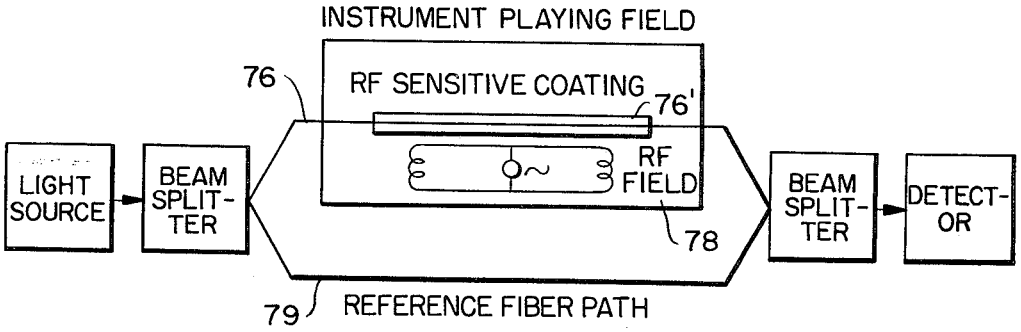
FIG. 7 is a diagramic illustration of radio frequency (RF) induced optical phase shifts which is another form of modulation modifying means of the invention.

Referring to FIG. 7, optical fibers 76 are coated as at 76' with a material such as $PVF_2$, PZT or Lithium Niobate sensitive to electro-magnetic forces, which constrict or expand within such a field. The coated part of the fiber 76', when caused to vibrate in an electromagnetic field created by coils or other RF circuitry 78, creates stresses on the fiber which cause optical phase shifts relative to the reference optic fiber 79 as described previously.

Temperature-Induced Phase Shifts

Figure 8:
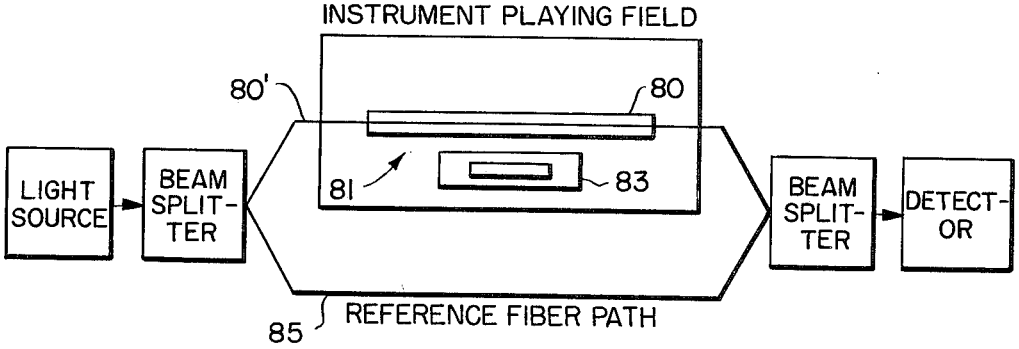
FIG. 8 is a diagramic illustration of temperature induced optical phase shifts which is another form of modulation modifying means of the invention.

Referring to FIG. 8, temperature sensitive coatings 80, such as Copper and Silver, are applied to optical fibers 80' which constrict or expand in the presence of a temperature differential. The coated part 80 of the fiber, when caused to vibrate in an area 81 of a higher or lower temperature induced by heater or cooler 83 cause periodic axial strains on the fiber and resulting optical phase shifts in the light contained in the fiber compared to reference Fiber 85.

Fiber Optic Guitar

Figure 9:
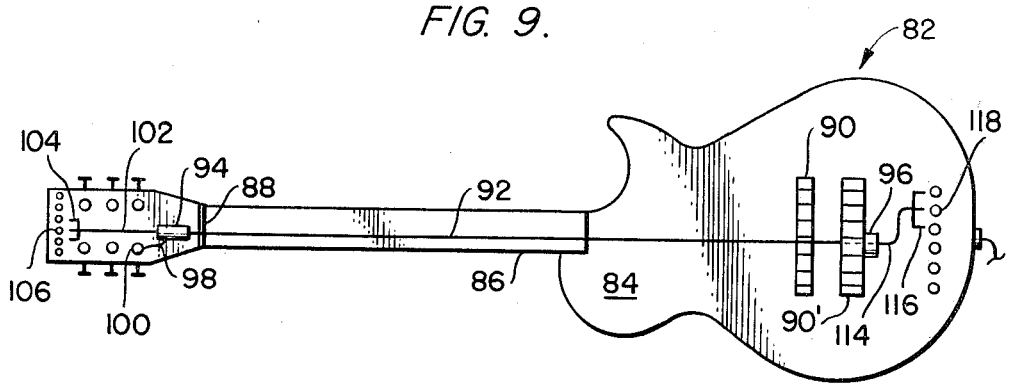
FIG. 9 is a diagramic plan view of a fiber optic guitar constructed in accordance with the teachings of the invention.
Figure 10:
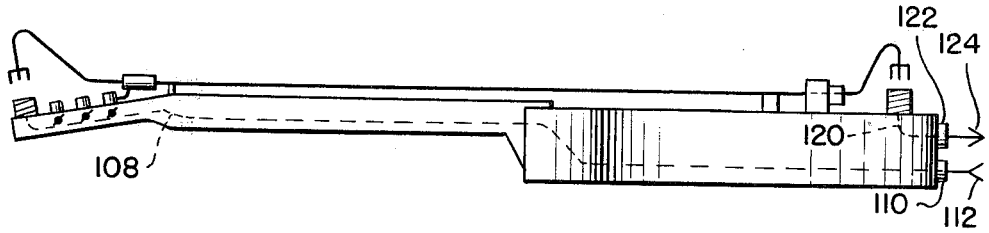
FIG. 10 is a longitudinal sectional view of the guitar illustrated in FIG. 9.

Referring particularly to FIGS. 9 and 10 of the drawing 82 generally designates a musical instrument configured as a guitar having a body portion 84 and a neck portion 86.

The instrument includes a neck bridge 88, a body bridge 90, and a tailpiece 90'.

The guitar is strung with 6 optical fibers 92. The optical fibers are of the type having a high index core and a low index cladding. The optical fiber(s) 92 may be constructed of glass or quartz or plastics as is well known in the fiber optic art. In order to maintain constant tensioning force over the six fiber optic strands to prevent neck warp, twisting and breakage, the diameters of the optical fibers would vary from, for example, 250 microns to 1,300 microns which would provide optical fiber variations over the three octaves generally spanned by a guitar having six strings in diameters from approximately ten gage (0.010") to about fifty gage (0.050"). While a 250 micron to 1,300 micron span would match the normal six strings of a guitar, it is considered that use of fibers with other comparable diameters would probably be sufficient.

As one method of tensioning, each of the optical fibers 92 is provided with a neck retainer 94 and a bridge retainer 96 which retainers may be cast, molded or otherwise fixed to the optical fiber. The bridge retainer 96 would be affixed to abutt against a tailpiece 90'. The retainer 94 would include an inserted wire 98 which would be wrapped around its conventional guitar string tightening mechanism 100 so that each of the optical fibers strings may be properly tensioned. The untensioned portion 102 of the optical fibers would be provided with a coupling socket 104 which would be threadedly received on a mating coupling socket 106 which in one form of the invention would be connected to an optical fiber 108 running down the neck 86 to a connector 110 which receives an incoming light source via a fiber optic feed cable 112.

The untensioned end 114 of each of the fibers is also provided with a threaded connector 116 which is received on its appropriate mating coupling socket generally designated 118. Socket 118 is then connected to an optical fiber 120 to a connector 122 which feeds the modulated light into a fiber optic return cable 124 to the detection and amplification processes.

Hybrid Fiber Optic Guitar

The fiber optic guitar previously described and illustrated in FIGS. 9 and 10 is totally optical and contains no electrical components. All electronics, light source, detection, amplification and other electrical processes are all performed external to the actual fiber optic music instrument body.

Another form of the invention will consist of varying forms of hybrid configurations which include electrical functions within the body of the guitar itself. One form of a hybrid fiber optic guitar is illustrated by FIGS. 11, 12 and 13.

Figure 11:
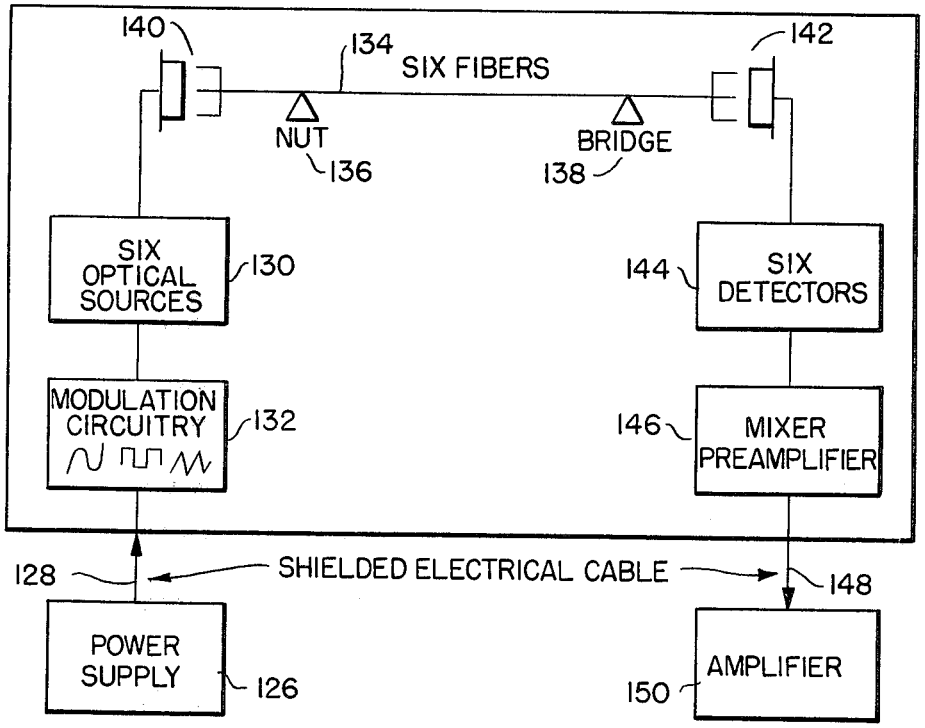
FIG. 11 is a block diagram of a hybrid fiber optic guitar with electrical inputs and outputs, and internal optical processing.

Referring to FIG. 11, AC or DC power 126 is provided via shielded electrical cable 128 to six optical sources 130; particularly infrared light emitting diodes (LEDs) in this case. The sources are driven either by steady state power, or modulated by circuitry 132 which superimposes various waveforms to create special effects as desired. Each of the optical sources is fed to one end of the six optical fibers 134 stretched between the nut 136 and bridge 138 via a fiber optic connector 140. The modulated light from each fiber is then passed through a second fiber optic connector 142 and caused to illuminate the face of photodetectors 144, particularly PIN diodes in this case. The electrical output of each detector, which is representative of the vibration intensity and frequency of each optical fiber, is fed to a six channel mixer/preamplifier 146 which combines the six electrical signals into one composite signal. The output of the preamplifier is then sent, via a shielded electrical cable 148 to an amplifier 150 external to the guitar. Shielded cables 128 and 148 can be enclosed in a common cable jacket.

Figure 12:
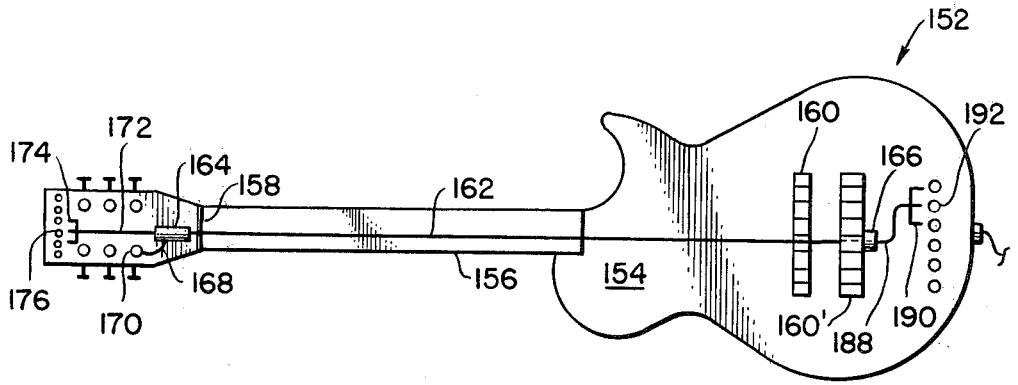
FIG. 12 is a diagramic plan view of the hybrid fiber optic guitar constructed in accordance with the teachings of the invention.
Figure 13:
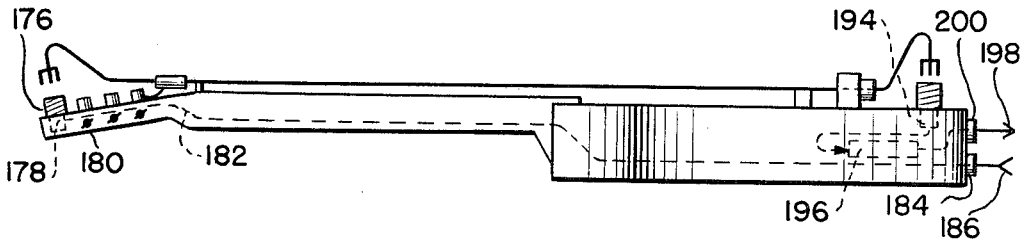
FIG. 13 is a longitudinal sectional view through the guitar illustrated in FIG. 12.

Referring particularly to FIGS. 12 and 13 of the drawing 152 generally designates a musical instrument configured as a guitar having a body portion 154 and a neck portion 156.

The instrument includes a neck bridge 158, a body bridge 160 and a tailpiece 160'.

The guitar is strung with six optical fibers 162. The diameters of the optical fibers would vary from approximately 250 microns to 1,300 microns as before.

Each of the optical fibers 162 is provided with a neck retainer 164 and bridge retainer 166 which retainers may be cast, molded or otherwise fixed to the optical fiber. The bridge retainer 166 would be affixed to abutt against a tailpiece 160'. The retainer 164 would include an inserted wire 168 which would be wrapped around its conventional guitar string tightening mechanism 170 so that each of the optical fiber strings may be properly tensioned. The untensioned portion 172 of each optical fiber is provided with a coupling socket 174 which would be threadedly received on a connector 176 which is attached to light emitting elements 178 which, in one form of the invention, would comprise of conventional IR-emitting diodes (LEDs) appropriately inserted in the head 180 of the guitar 152. The LED's are connected to a source of power through electrical wiring 182 running through the neck and body to a connector 184 to a shielded electrical cable 186.

The untensioned end 188 of each of the fibers is also provided with a threaded connector 190 which is received on a mating connector 192 which is attached to appropriate photodetectors generally designated 194. The photodetectors 194 are of conventional design and suitable for receiving the wavelength of the light emitted by the light source. The detectors 194 would be connected to a mixer-preamplifier 196 within the guitar, and the combined electrical signal would be fed to a shielded electrical output cable 198 via a connector 200. Connectors 184 and 200 may comprise the same connector in a multi-pin configuration, and the electrical input and output signal cables 186 and 198 may share a common cable jacket.

String Configurations

While the present invention has been specially described in reference to a guitar having six strings, six light sources and six photodetectors, it will be appreciated by those skilled in the art that the complexity of the system may be reduced by using only a single fiber with a single light source and a single detector. The single fiber would be routed up and down the length of the guitar in successive bridges and notches and at each point that is bridged or notched which would serve as microbend fulcrum for a particular string length.

Referring to FIGS. 14*a*–14*d*, there are illustrated several optical configurations which may be utilized within the fiber optic guitar or other fiber optic musical instrument forms.

Figure 14A:
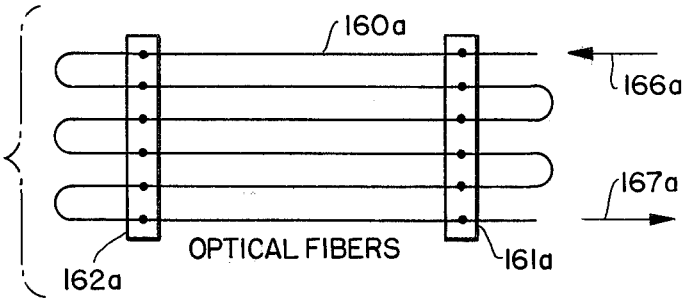
FIGS. 14*a* through 14*d* illustrate optical fiber configuration variations possible in a fiber optic guitar.

In FIG. 14*a* a single optic fiber 160*a* is strung between a bridge 161*a* and a nut 162*a*. Light from an optical source is directed into the fiber 160*a* as indicated by arrow 166*a* and the modulated light is detected at the light output 167*a*.

Figure 14B:
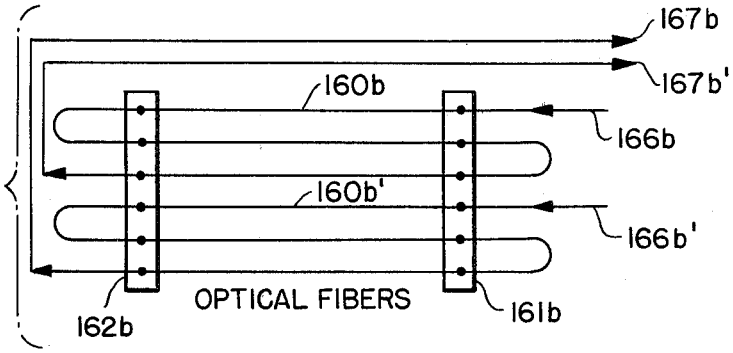

FIG. 14*b* illustrates a two fiber configuration composed of optic fibers 160*b* and 160*b'* *strung between bridge* 161*b* and nut 162*b*. (Light from the two optical sources) 166*b* (and) 166*b'* *is directed to the fibers* 160*b* and 160*b'* *respectively as illustrated. The modulated light is detected at* 167*b* and 167*b'*.

Figure 14C:
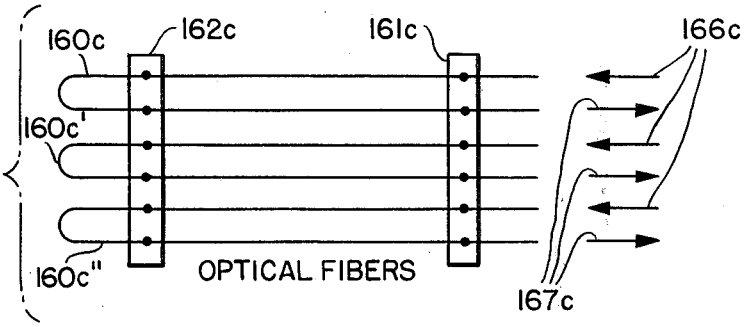

In FIG. 14*c* a three fiber configuration is illustrated consisting of fibers 160*c*, 160*c'* and 160*c''* which are strung between bridge 161*c* and nut 162*c*. Light enters the fibers as indicated by arrows 166*c* and the modulated light is detected at output arrows 167*c*.

Figure 14D:
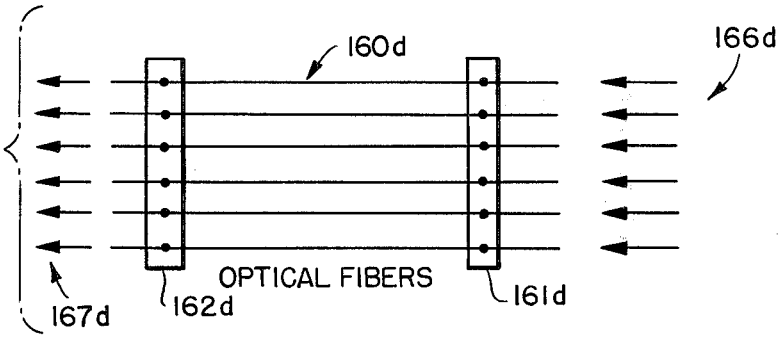

In FIG. 14*d* a six fiber configuration is illustrated consisting of six optic fibers 160*d*, each of which is strung between bridge 161*d* and nut 162*d*. Each of the six fibers is provided with its own optical light source as at 166*d* and its modulated light output means 167*d*.

Input/Output Configurations

Figure 15:
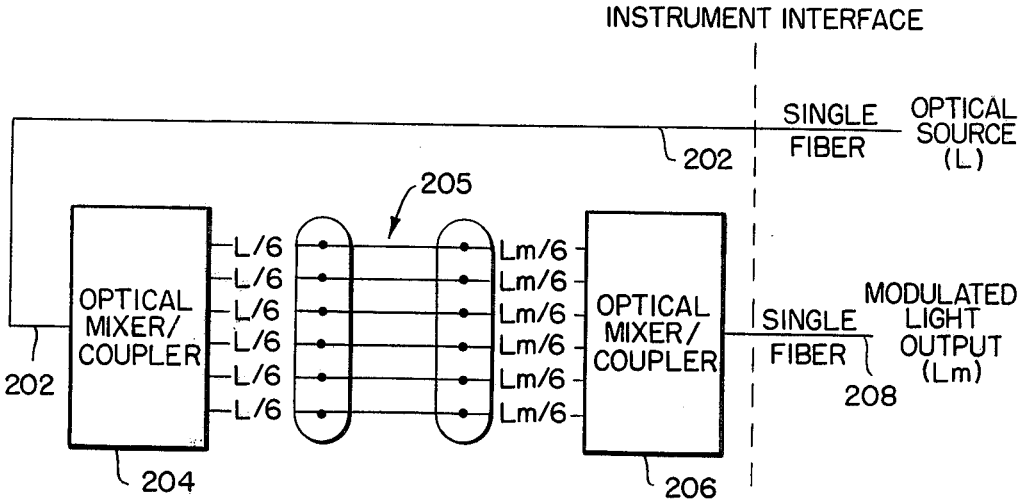
FIG. 15 is an illustration of a single input/output fiber optic musical instrument configuration with multifiber otpical mixing.
Figure 16:
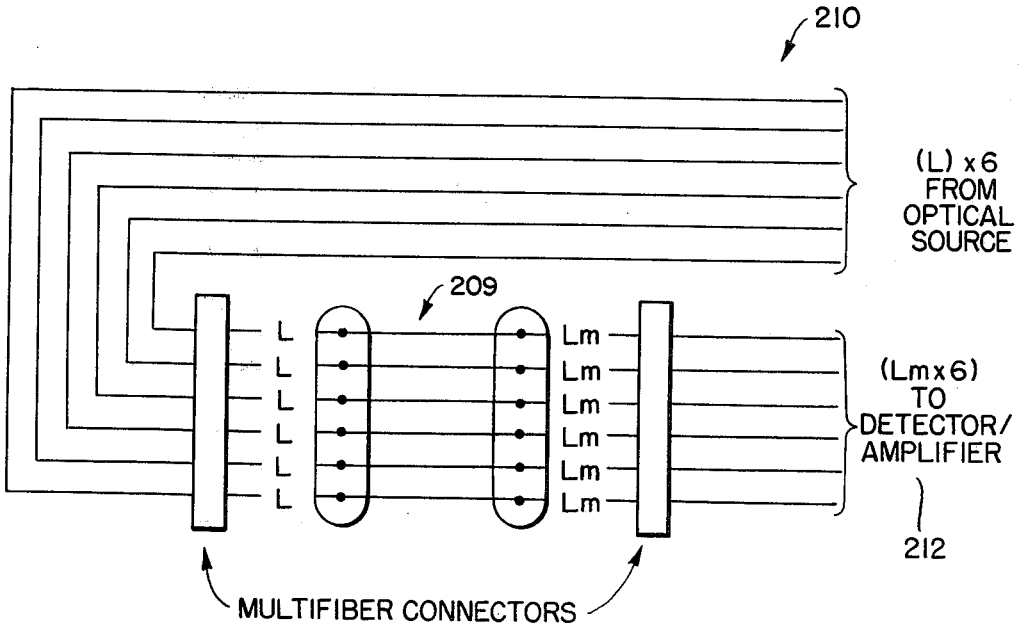
FIG. 16 is an illustration of a multifiber input/output fiber optic musical instrument configuration.

Referring to FIGS. 15 and 16, there are also a number of techniques possible in the receiving of optical sources, distribution of the light source among existing musical instrument fibers, and the transmission of the modulated light output. FIG. 15 illustrates one method in which a single optical source L directed to single optical fiber 202 and is converted by an optical mixer/coupler 204 into six light sources of equally reduced intensity and distributed to each fiber 205, and then recombined by an optical mixer/coupler 206 into a single modulated light output Lm which is transmitted via fiber 208.

FIG. 16 illustrates a scheme wherein each musical instrument optical fiber 209 is provided its own light source L via optical fibers 210 at one end, and emits its own unique modulated light Lm at output 212 at the other end. Multifiber cables may be employed in this case to optically transmit the signals from the external light sources and to the detection devices.

Other Fiber Optic Musical Instrument Forms

Figure 17A:
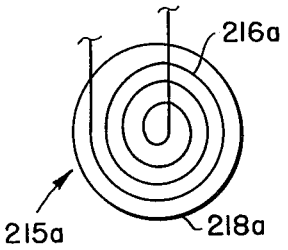
FIGS. 17*a*, 17*b* and 17*c* illustrate examples of the application of the teachings of the invention applied to drums.
Figure 17B:
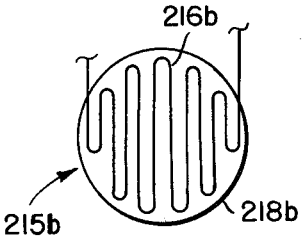
Figure 17C:
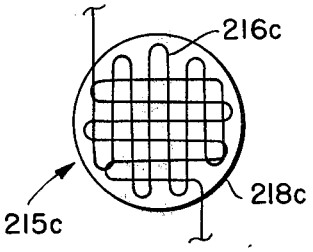
Figure 18A:
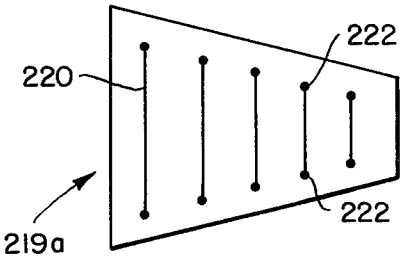
FIGS. 18*a* and 18*b* illustrate the use of the invention on xylophones.
Figure 18B:
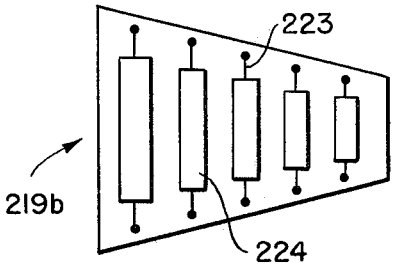
Figure 19A:
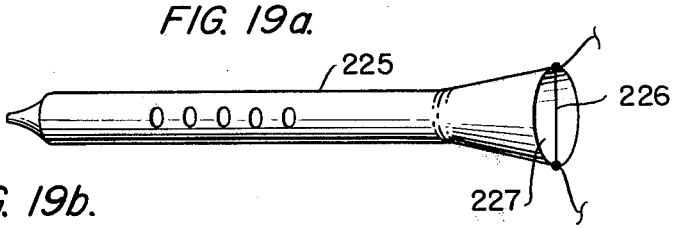
FIGS. 19*a* and 19*b* illustrate the application of optical fibers to wind instruments.
Figure 20:
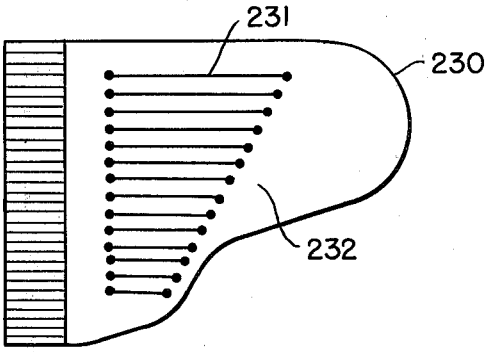
FIG. 20 illustrates the application of the teachings of the invention applied to a piano.

FIGS. 17*a*, *b* and *c*, FIGS. 18*a* and *b*; FIGS. 19*a* and *b* and FIG. 20 illustrate other musical instrument forms other than stringed instruments of the guitar, violin and banjo variety.

In FIGS. 17*a*, *b* and *c* references 215 *a*, *b* and *c* denote possible applications of the invention in percussion instruments wherein optical fibers 216*a*, *b* and *c* are attached to, or imbedded in, the membrane of drum heads 218*a*, *b* and *c* in a number of possible geometric patterns. Hitting the drum heads will exert pressure on the fibers which will alter the optical path length and modulate the contained light as previously described.

FIGS. 18*a* and *b* show another percussion application in the form of a xylophone 219*a* and *b* in which either optical fibers 220 of varying lengths are stretched between fulcrums 222 and hit by mallets, or the fibers 223 are imbedded or attached to conventional xylophone tone blocks 224 which, when hit, will exert similar vibrational pressure upon the fibers.

FIG. 19*a* illustrates a wind instrument 225 having a fiber 226 stretched across the air cavity end 227. As the air (musical note) exits the instrument, it vibrates the fiber 226, thus modulating the light per transduction phenomena previously described.

Figure 19B:
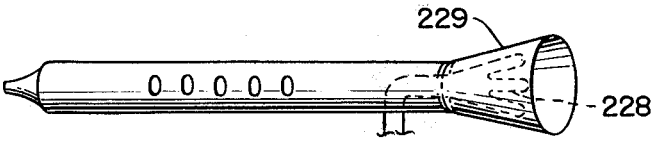

In another application, FIG. 19*b* the optical fiber 228 is attached to, or imbedded in, the body 229 of the wind instrument to sense the vibrations created by the air flow.

FIG. 20 illustrates a fiber optic piano 230 wherein optical fibers 231 are stretched across the sounding board 232, replacing current piano wire, and are hit by the piano hammers in a conventional manner.

Optical Source Modulation Techniques

FIG. 21 illustrates several methods of modulating the optical source(s) of a fiber optic musical instrument to create special effects.

The voltage from a fixed power supply 299 is normally used to provide steady state power to the optical source 300.

The optical source 300 can be modulated by voices or other audio sounds via microphone 302 by the use of an Amplitude Modulator (AM), Frequency Modulator (FM), Side Band Modulator (Single Side Band SSB or Double Side Band DSB), Phase Modulator (PM), Digital Modulator, or other desired technique as illustrated at 304.

The optical source can additionally be modulated by a sine wave generator 306, to create a tremelo effect at low sine wave frequencies, or special effects at higher frequencies; by a square wave generator 308 to create a distorted "Fuzz" effect, or by a sawtooth wave generator 310 or other wave form generator to create other special effects such as synthesizer sounds. A conventional switching means 312 may be employed to connect one or more of such devices 299, 304, 306, 308 and/or 310 to the optical source 300; then to the instrument's optical fiber 314.

I claim:

1. A musical instrument comprising a musical instrument housing, at least one optical fiber, means embedding or affixing said at least one optical fiber to said musical instrument housing unique to the particular musical instrument housing, means remote from the musical instrument housing for directing a light beam from one end of said fiber to the other, light detecting means remote from the musical instrument housing at the other end of said fiber, whereby when said at least one optical fiber is caused to vibrate the light beam in said fiber is modified, said detecting means including means for producing an electrical signal proportional to the modified light beam, and means for amplifying the electrical signal, including means for intensity modulating the light traveling in said at least one optical fiber.

2. The invention defined in claim 1 wherein the musical instrument housing is from the family consisting of stringed, percussion, woodwind, brass or keyboard instrument housings.

3. The musical instrument as defined in claim 1, wherein the instrument is from the group consisting of a guitar, a banjo, a violin, a viola, a cello, a fiddle, a drum, a woodwind instrument, a brasswind instrument, a piano, an accordion, a harmonica and a harp.

4. A musical instrument comprising a musical instrument housing, at least one optical fiber, means embedding or affixing said at least one optical fiber to said musical instrument housing unique to the particular musical instrument housing, means remote from the musical instrument housing for directing a light beam from one end of said fiber to the other, light detecting means remote from the musical instrument housing at the other end of said fiber, whereby when said at least one optical fiber is caused to vibrate the light beam in said fiber is modified, said detecting means including means for producing an electrical signal proportional to the modified light beam, and means for amplifying the electrical signal, including means for intensity modulating the light traveling in said at least one optical fiber and said intensity modulation is caused by microbending or vector rotation.

5. A musical instrument comprising a musical instrument housing, at least one optical fiber, means embedding or affixing said at least one optical fiber to said musical instrument housing unique to the particular musical instrument housing, means remote from the musical instrument housing for directing a light beam from one end of said fiber to the other, light detecting means remove from the musical instrument housing at the other end of said fiber, whereby when said at least one optical fiber is caused to vibrate the light beam in said fiber is modified, said detecting means including means for producing an electrical signal proportional to the modified light beam, and means for amplifying the electrical signal, wherein the at least one optical fiber is coated with a magnetic, RF or temperature sensitive material.

6. The invention in claim 5, including a reference fiber path and means for phase modulating the light traveling in said at least one optical fiber.

7. The invention in claim 6, wherein the phase modulated light is detected by means remote from the musical instrument housing.

8. A musical instrument comprising a musical instrument housing, at least one optical fiber, means embedding or affixing said at least one optical fiber to said musical instrument housing unique to the particular musical instrument housing, means remote from the musical instrument housing for directing a light beam from one end of said fiber to the other, light detecting means remote from the musical instrument housing at the other end of said fiber, whereby when said at least one optical fiber is caused to vibrate the light beam in said fiber is modified, said detecting means including means for producing an electrical signal proportional to the modified light beam, and means for amplifying the electrical signal, wherein the means remote from the musical instrument housing for directing a light beam from one end of the said at least one fiber to the other includes an optical source energized by a voltage modulated to create special effects.

9. The musical instrument as defined in claim 8, wherein the means for directing a light beam from a light source remote from the musical instrument housing to one end of the embedded or affixed at least one optical fiber is a fiber optic cable.

10. The musical instrument as defined in claim 8, wherein there are a plurality of optical fibers and optical mixing means distribute the source of light to said fibers and mixing means recombine the modified light issuing at the other end of said optical fibers.

11. The musical instrument as defined in claim 8, wherein the voltage is modulated by waveforms from the group consisting of sine waves, square waves, sawtooth waves and waves having voice qualities.

* * * * *